US011865472B2

(12) United States Patent
Carson et al.

(10) Patent No.: US 11,865,472 B2
(45) Date of Patent: Jan. 9, 2024

(54) PUSH AND PULL TOY

(71) Applicant: TOMY International, Inc., Oak Brook, IL (US)

(72) Inventors: Adam Carson, Oak Brook, IL (US); Mark Carson, Oak Brook, IL (US)

(73) Assignee: FAT BRAIN TOY CO., LLC, Elkhorn, NE (US)

( * ) Notice: Subject to any disclaimer, the term of this patent is extended or adjusted under 35 U.S.C. 154(b) by 50 days.

(21) Appl. No.: 17/656,115

(22) Filed: Mar. 23, 2022

(65) Prior Publication Data

US 2023/0302378 A1 Sep. 28, 2023

(51) Int. Cl.
*A63H 33/08* (2006.01)
*A63H 33/06* (2006.01)
*A63H 5/00* (2006.01)

(52) U.S. Cl.
CPC ..... *A63H 33/062* (2013.01); *A63H 5/00* (2013.01)

(58) Field of Classification Search
CPC ..... A63H 33/062; A63H 5/00
See application file for complete search history.

(56) References Cited

U.S. PATENT DOCUMENTS 3,456,948 A * 7/1969 Bosco ..... H01H 51/28 273/287
4,045,013 A * 8/1977 Coster ..... A63B 71/0672 273/281
D248,412 S * 7/1978 Brown ..... D21/344
5,311,834 A * 5/1994 Ross ..... B42D 9/00 116/306
5,566,846 A * 10/1996 James ..... B65D 79/0087 428/209
5,819,968 A * 10/1998 Jones ..... B65D 50/043 215/230
5,967,350 A * 10/1999 Jones ..... B65D 51/245 215/230
6,564,934 B1 * 5/2003 Dischler ..... B65D 51/2828 206/219
6,938,768 B2 * 9/2005 Ferretti ..... B65D 43/0212 215/230
7,771,200 B2 * 8/2010 Schultz ..... B42D 3/12 434/188

(Continued)

OTHER PUBLICATIONS

Learning Express Birmingham, New Pull N' Pops!, Feb. 8, 2022, YouTube Video, 4 screenshots.*

(Continued)

*Primary Examiner* — Eugene L Kim
*Assistant Examiner* — Matthew B Stanczak
(74) *Attorney, Agent, or Firm* — Husch Blackwell LLP

(57) ABSTRACT

A toy comprising a frame and an inverting toy. In some embodiments, the inverting toy includes an invertible shell having a first surface and a second surface, the invertible shell configured to protrude outward in a first direction with respect to the frame until a depressing force on the first surface or the second surface in a second direction causes the shell to invert and protrude in the second direction with respect to the frame, wherein the first direction and the second direction are substantially opposite, an edge member formed at an edge of the invertible shell and configured to secure the invertible shell to the frame, and a pulling member formed on and protruding outward from the first surface of the invertible shell.

19 Claims, 6 Drawing Sheets

(56) References Cited

U.S. PATENT DOCUMENTS

| | | | | | |
|---|---|---|---|---|---|
| 8,201,691 | B1 * | 6/2012 | Chowdhury | A61J 7/04 116/306 |
| D930,084 | S * | 9/2021 | Ye | D21/468 |
| D941,398 | S * | 1/2022 | Zhang | D21/468 |
| D944,329 | S * | 2/2022 | Deng | D21/468 |
| D944,332 | S * | 2/2022 | Yu | D21/468 |
| D946,660 | S * | 3/2022 | Deng | D21/350 |
| D947,061 | S * | 3/2022 | Deng | D21/468 |
| D947,953 | S * | 4/2022 | Cui | D21/468 |
| D948,630 | S * | 4/2022 | Yu | D21/468 |
| D955,485 | S * | 6/2022 | Huang | D21/303 |
| D961,004 | S * | 8/2022 | Zeng | D21/468 |
| D967,281 | S * | 10/2022 | Wang | D21/468 |
| D967,282 | S * | 10/2022 | He | D21/468 |
| D968,080 | S * | 11/2022 | Lin | D21/468 |
| D969,226 | S * | 11/2022 | Peng | D21/468 |
| D969,228 | S * | 11/2022 | Chen | D21/468 |
| D969,229 | S * | 11/2022 | Chen | D21/468 |
| D969,230 | S * | 11/2022 | Dai | D21/615 |
| D970,636 | S * | 11/2022 | Yang | D21/468 |
| D970,637 | S * | 11/2022 | Yang | D21/468 |
| D970,640 | S * | 11/2022 | Yang | D21/468 |
| D970,644 | S * | 11/2022 | Shi | D21/468 |
| D970,645 | S * | 11/2022 | Shi | D21/468 |
| D972,654 | S * | 12/2022 | You | D21/468 |
| D974,488 | S * | 1/2023 | Yin | D21/468 |
| D975,787 | S * | 1/2023 | Peng | D21/468 |
| D976,334 | S * | 1/2023 | Capon | D21/468 |
| D977,584 | S * | 2/2023 | Dai | D21/468 |
| D979,660 | S * | 2/2023 | Song | D21/468 |
| 2018/0311590 | A1 * | 11/2018 | Rasmussen | G02B 6/0005 |
| 2020/0360799 | A1 * | 11/2020 | McLachlan | A63F 9/1208 |
| 2022/0023150 | A1 * | 1/2022 | Taylor | A61J 7/04 |
| 2022/0176235 | A1 * | 6/2022 | McLachlan | A63H 33/42 |
| 2023/0211248 | A1 * | 7/2023 | Lagimoniere, Jr. | A63H 5/00 446/486 |

OTHER PUBLICATIONS

P_Things, DIY—Pop it Fidget Toy, May 20, 2021, YouTube Video, 2 screenshots.*

* cited by examiner

PUSH AND PULL TOY

FIELD

The present invention generally relates to children's toys. More particularly, the present invention relates to a toy for improving a child's motor functions.

BACKGROUND

Toys having invertible shells are known in the art. In conversational lexicon, these invertible shell toys are sometimes referred to as "pop-it" toys. Invertible shell toys comprise one or more pokable bubbles that can be flipped and re-used. A user can press or poke the invertible shells on a convex side of the shell and cause the shell to invert, causing the shell to appear concave from the pushed or poked side and emerging as convex on another side of the toy. Poking the invertible shell to the point of inversion results in a satisfying sensation at a user's finger tips. Typically, invertible shell toys distribute numerous invertible shells on a flat board.

The first known "pop-it toy" was disclosed in U.S. Pat. No. 4,045,013 titled "Marker Board", filed in 1974. As described in the '013 Patent, the invertible shells are dome shaped and respectively formed of increased flexibility compared to rings that surround each dome-shaped shell, and an axial depressing force exerted on a tip portion of one of the shells results in its depression and inversion. In the nearly 50 years since the filing of the '013 Patent, conventional invertible shell toys are structurally identical to the invertible shells disclosed by the '013 Patent and have not changed since the original disclosure.

Pop-it toys have become popular for entertaining young children or being used as stress relievers by adolescents and adults. When given to young children and infants, conventional invertible shell toys develop only a limited number motor skills, namely pushing or poking. However, conventional invertible shell toys cannot help a young child or infant develop other, important motor skills, such as grasping, pulling, clenching, clasping, and the like.

In view of the above, there is a continuing, ongoing need for an improved toy that develops additional motor skills.

DETAILED DESCRIPTION

Figure 1:
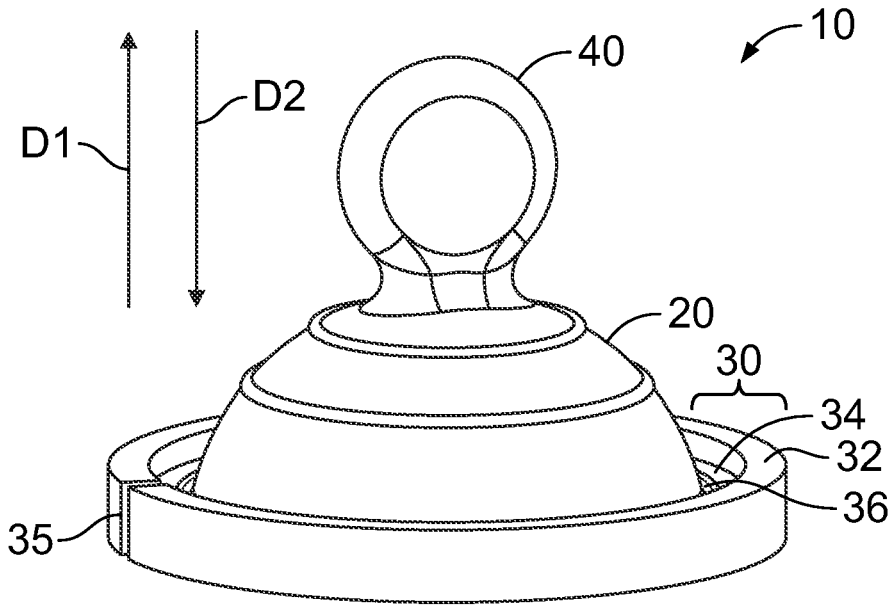
FIG. 1 illustrates an invertible shell having a pulling member according to exemplary embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Figure 2:
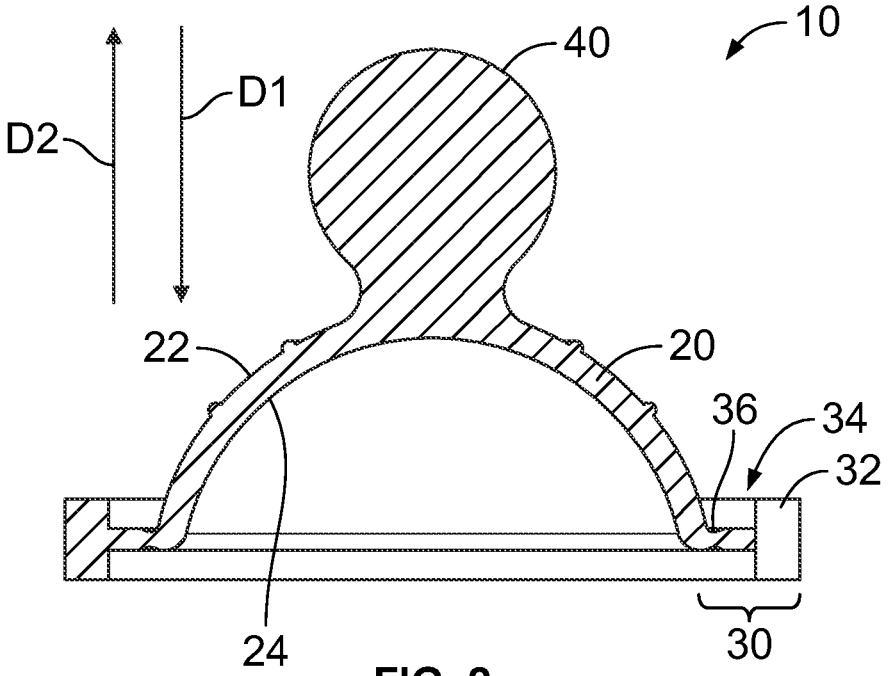
FIG. 2 is a cross-sectional view of the invertible shell having the pulling member according to exemplary embodiments.

Embodiments disclosed herein can include an inverting toy 10 comprising an invertible shell 20. As seen in FIGS. 1 and 2, the invertible shell 20 can include a shell portion having a first surface 22 and a second surface 24. The invertible shell 20 can further include an edge member 30 and a pulling member 40. The invertible shell 20 can have a dome shape, but other shapes are envisioned, such as a star shape, a generally square or rectangular shape, or any other shape.

The invertible shell 20 can protrude outward in either a first direction D1 or a second direction D2. As shown in FIGS. 1 and 2, the first direction D1 and the second direction D2 can be substantially opposite in direction. FIGS. 1 and 2 illustrate the invertible shell 20 protruding outward in the first direction D1, which can be an initial shape of the inverting toy 10 because the inverting toy 10 was formed or molded as protruding outward in the first direction D1, but the invertible shell 20 can also protrude outward in the second direction D2 after inversion. For example, the invertible shell 20 can protrude outward in the second direction D2 in response to a depressing force in the second direction D2 from a user on the first surface 22 causing the invertible shell 20 to invert and protrude outward in the second direction D2. When the invertible shell 20 protrudes in the second direction D2, a depressing force in the first direction D1 from the user on the second surface 22 can cause the invertible shell 20 to invert and protrude outward in the first direction D1. Additionally, a pulling force on the pulling member 40 in the first direction D1 can cause the invertible shell 20, when initially protruding in the second direction D2, to invert and protrude outward in the first direction D1. The invertible shell 20 can invert numerous times. Inverting the protruding direction of the invertible shell 20 can cause a popping sensation at the user's fingertips for entertainment or stress relieving purposes. In some embodiments, the invertible shell 20 can comprise silicone or any other soft or flexible plastic that allows the inverting shell 20 to invert. In some embodiments, the invertible shell 20 can further include concentric rings formed on the first surface to give the invertible shell 20 additional texture.

In the dome-shaped embodiment shown in FIGS. 1 and 2, the edge member 30 can comprise an annular ring surrounding the invertible shell 20 and coupled to the invertible shell 20 at a circumference of the dome-shaped invertible shell 20. Regardless of shell shape, the edge member 30 can substantially correspond in shape to the shape of the invertible shell 20 and be formed at an outer edge of the invertible shell 20. The edge member 30 can include a flange 32 and a trench 34, as best shown in FIG. 2. The flange 32 and trench 34 can interlock with a corresponding member to secure the inverting toy 10. The edge member 30 can further include a slit 35 that interlocks with a corresponding notch formed on another component to prevent rotation of the inverting toy 10 about its axis. The edge member 30 can further include a rut 36 formed in the trench 34 near the outer edge of the invertible shell 20. The rut 36 can activate in response to the invertible shell 20 inverting. The rut 36 can allow the popping sensation when the invertible shell 20 inverts from protruding from the first direction D1 to the second direction D2 to be substantially equal to the popping sensation when the invertible shell 20 inverts from protruding from the second direction D2 to the first direction D1. In some embodiments, the rut 36 can also invert.

The pulling member 40 can be formed on and protrude outward from the first surface 22 of the invertible shell 20. The pulling member 40 allows the user to grasp the pulling member 40 and pull the pulling member 40 in the first direction and cause the invertible shell 20, when protruding in the second direction, to invert and protrude outward in the first direction D1. The user can also push on the pulling member 40 or the surface 22 in the second direction D1 to cause the invertible shell 20 to invert and protrude outward in the second direction D2. The pulling member 40 can comprise the same material as the invertible shell 20 (e.g., silicone). In some embodiments, the invertible shell 20, the edge member 30, and the pulling member 40 can be singularly formed, such as through an injecting molding, co-molding, or molding process. Alternatively, the invertible shell 20, the edge member 30, and the pulling member 40 can comprise separate components coupled together via an adhesive.

Figure 3:
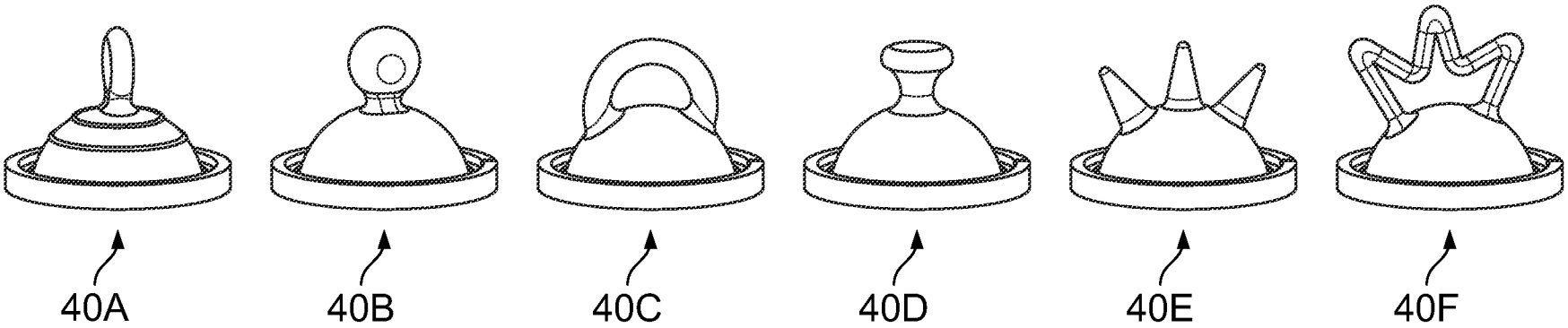
FIG. 3 illustrates various configurations of the pulling member according to exemplary embodiments.

The pulling member 40 can comprise a variety of different shapes and configurations, as shown in FIG. 3. For example, the pulling member 40 can include a ring shape 40A, a spherical knob shape 40B, a handle shape 40C, a round knob shape 40D, a jagged handle shape 40F, and a shape having one or more posts 40E. In the post embodiment 40E, FIG. 3 illustrates an embodiment having three posts, but any number of posts are envisioned. In addition, the posts of the post handle embodiment 40E can be distributed anywhere on the first surface 22 of the invertible shell 20 and are not required to be distributed in a linear manner. Additionally, the pulling member 40 can include a tab shape, such as the pulling member 40 shown in FIGS. 1 and 2. The tab can include a concave portion substantially in the center of the pulling member, on each side of the tab, to correspond with the convex shape of a finger, thereby making the tab more comfortable and easier to grasp. The outer circumference of the tab shape can be substantially circular.

Figure 4:
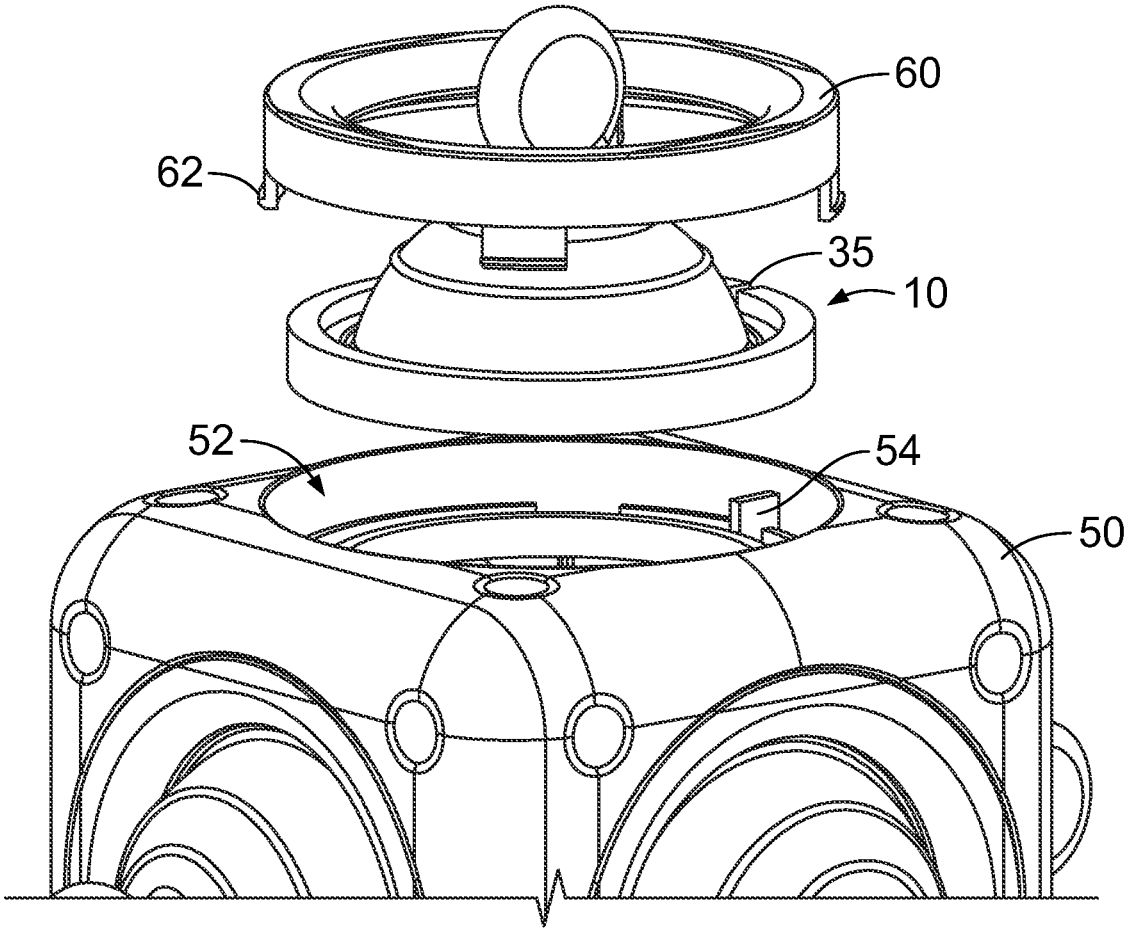
FIG. 4 illustrates a relationship between the invertible shell and a frame according to exemplary embodiments.

As described above, the inverting toy 10 can be secured to a separate component. In some embodiments, the inverting toy 10 can be secured to a frame 50 as shown in FIG. 4. The frame 50 can include one or more bores or holes 52 for receiving the inverting toy 10. The bores or holes 52 can correspond in shape to the inverting toy 10. The frame 50 can receive the inverting toy 10 and a securing unit 60 in each of the holes or bores 52. The frame 50 can include a notch 54 that fits within the slit 35, thereby preventing rotation of the inverting toy 10 about its axis within one of the holes or bores 52.

The securing unit 60 can correspond in shape with the edge member such that it interlocks with the flange 32 and trench 34. The securing unit 60 can include a tab 62 that is received by a corresponding slot 56 (see FIG. 5) in the frame 50 to secure the securing unit 60 to the frame 50, thereby securing the inverting toy 10 to the frame 50. In some embodiments, the securing unit 60 comprises silicone and matches a color of the inverting toy 10. The securing unit 60 and the inverting toy 10 can comprise numerous colors.

Figure 5:
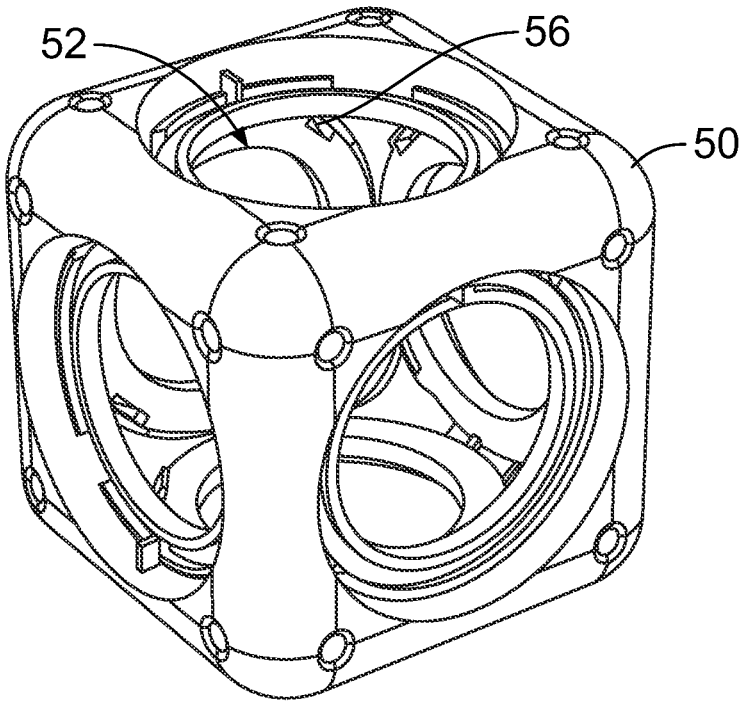
FIG. 5 illustrates the frame of a toy according to exemplary embodiments.
Figure 6:
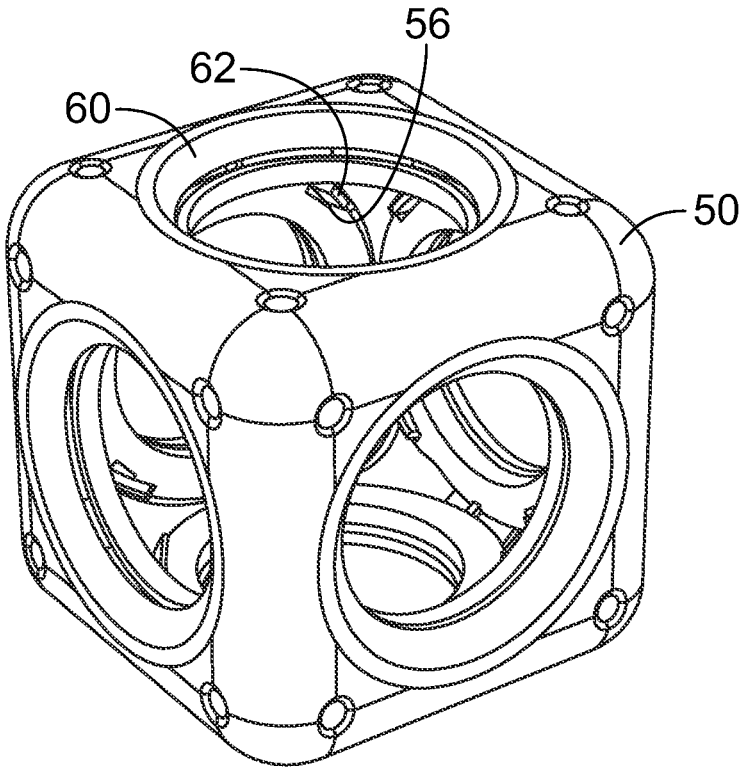
FIG. 6 illustrates the frame and securing rings according to exemplary embodiments.

As better shown in FIGS. 5 and 6, the frame 50 can comprise a cubic or box shape having six sides. In a box-shaped embodiment, the frame 50 can include six holes or bores 52. However, the exemplary embodiments described herein are not limited to a box-shaped frame or a six-hole embodiment, and the frame 50 shape can include a flat frame, a spherical frame, a pyramidal frame, a U-shaped frame, or any other shape. FIG. 6 illustrates the securing member 60 connected to the frame 50 when each tab 62 locks into slots 56.

Figure 7:
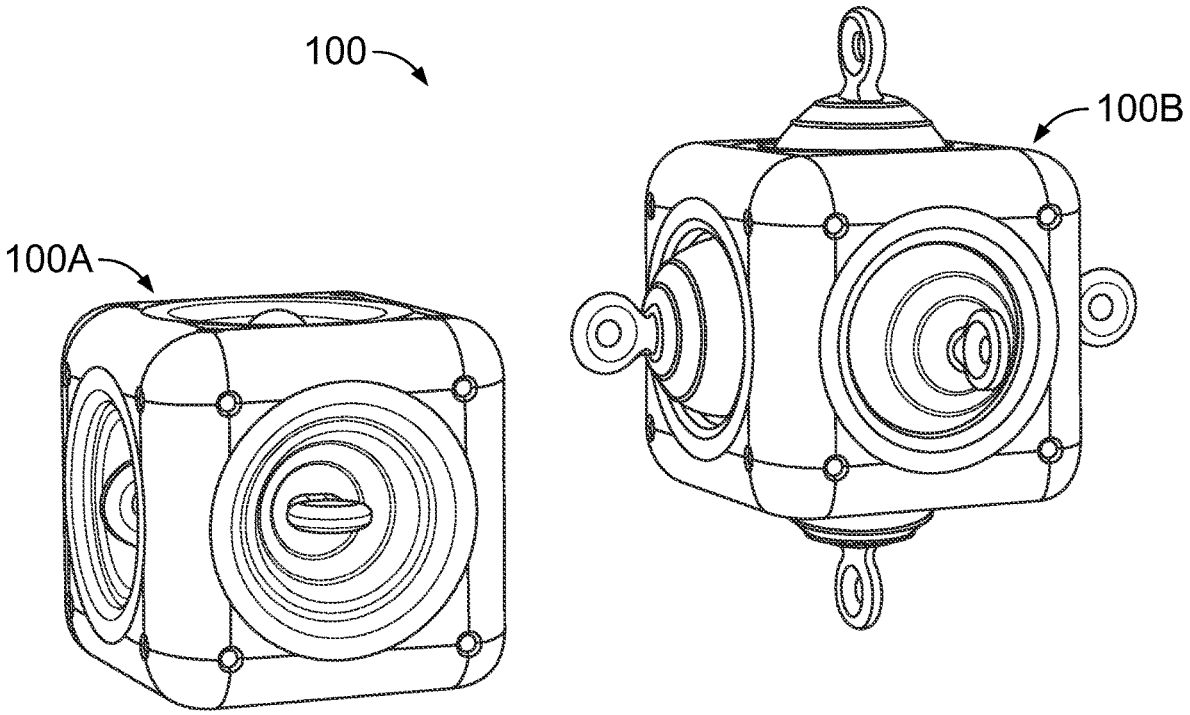
FIG. 7 is a perspective view of a toy with invertible shells pushed in and a toy with invertible shells pulled out according to exemplary embodiments.

FIG. 7 illustrates a toy 100 according to an exemplary embodiment. As shown in FIG. 7, the toy 100 includes the box-shaped frame, six inverting toys, each having a pulling member, and six securing members. The toy 100 can be comprised of multi-colored inverting toys and securing members. FIG. 7 shows that each of the inverting toys can protrude inward into the box-shaped frame, as shown in scenario 100A, and the inverting toys can protrude outward from the box-shaped frame, as shown in scenario 100B. While scenario 100A shows all visible inverting toys as protruding inward and scenario 100B shows all visible inverting toys as protruding outward, each inverting toy can be independently inverted, and the protruding direction of one of the inverting toys does not affect the inverting direction of any other inverting toy. In other words, each inverting toy inverts independently of all other associated inverting toys secured on the same frame.

As seen in FIG. 7, the toy 100 includes invertible shells that invert, providing a desired popping sensation, in response to both a pushing and a pulling force. An infant using the toy 100 can develop both pushing (i.e., poking) and pulling motor skills, as well as other skills such as grasping, clenching, or clasping. Moreover, the pulling member 40 must be grasped, usually by two fingers (i.e., thumb and index finger), which further develops a grasping and clenching motor skill. In this way, the toy 100 described herein is an improvement over prior art pop-it toys that only allowed a user to develop poking skills because the prior art pop-it toys only inverted in response to poking forces.

Figure 8:
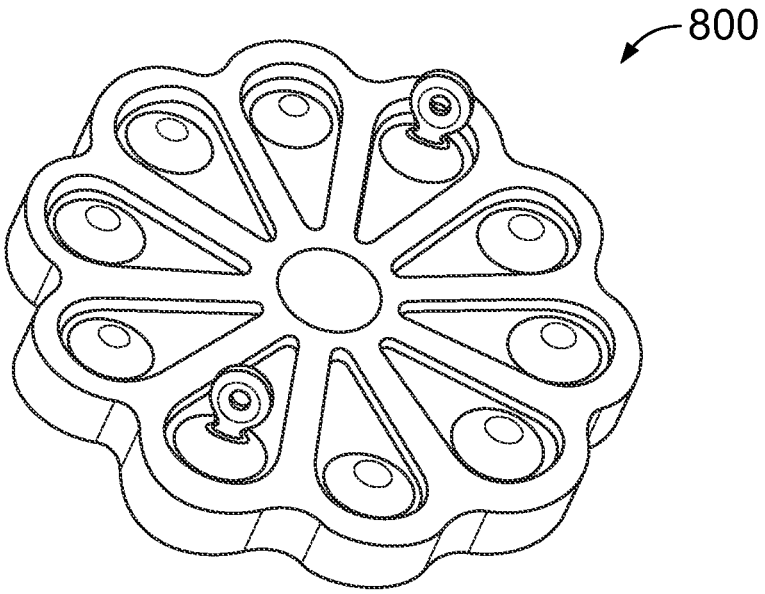
FIG. 8 is a perspective view of the invertible shell having a pulling member in an array toy according to an exemplary embodiment.
Figure 9:
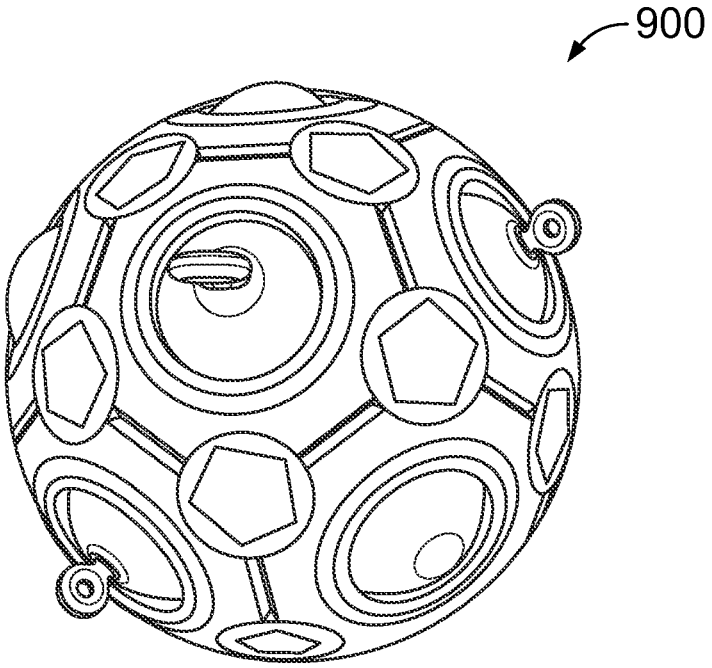
FIG. 9 is a perspective view of the invertible shell having a pulling member in a spherical toy setting according to an exemplary embodiment.

The toy 100 may or may not be a stand-alone toy. In some embodiments, the toy 100 can be implemented as part of another context, such in a high-chair or as part of an activity board having other toy types other than inverting shell toys. Additionally, referring now to FIGS. 8 and 9, the toy 100 can be incorporated into an array 800 of inverting shells, as shown in FIG. 8, or as part of a sphere 900 having numerous inverting shells, as shown in FIG. 9. As illustrated, not every inverting shell in the array 800 or the sphere 900 includes a pulling member, but in some embodiments, every inverting shell in the array 800 or the sphere 900 can include a pulling member Although a few embodiments have been described in detail above, other modifications are possible. For example, other components may be added to or removed from the described systems, and other embodiments may be within the scope of the invention.

From the foregoing, it will be observed that numerous variations and modifications may be affected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A toy comprising:

a frame; and an inverting toy comprising:

an invertible shell having a first surface and a second surface, the invertible shell configured to protrude outward in a first direction with respect to the frame until a depressing force on the first surface or the second surface in a second direction causes the shell to invert and protrude in the second direction with respect to the frame, wherein the first direction and the second direction are substantially opposite;

an edge member formed at an edge of the invertible shell and configured to secure the invertible shell to the frame; and a pulling member formed on and protruding outward from the first surface of the invertible shell, wherein the edge member further comprises a slit that receives a notch formed on the frame, the slit and notch configured to prevent rotation of the inverting toy about its axis within the frame.

2. The toy of claim 1 wherein the frame comprises a box-shaped frame having six holes or bores for receiving six of said inverting toys, wherein one hole or bore is formed on each side of the box-shaped frame.

3. The toy of claim 1 wherein the invertible shell has a dome shape.

4. The toy of claim 1 wherein a pulling force on the pulling member in the first direction causes the invertible shell, when protruding outward in the second direction, to invert and protrude outward in the first direction.

5. The toy of claim 1 wherein the edge member comprises a trench, a flange, and a rut formed within the trench, the flange formed at an outer edge of the trench.

6. The toy of claim 5 wherein the rut activates in response to the invertible shell inverting, and wherein the rut causes a first popping sensation when the invertible shell inverts from protruding from the first direction to the second direction to be substantially equal to a second popping sensation when the invertible shell inverts from protruding from the second direction to the first direction.

7. The toy of claim 5 further comprising a securing member comprising a tab received by a slot in the frame, the securing member having a corresponding shape to the edge member to interlock with the edge member and secure the inverting toy to the frame.

8. The toy of claim 1 wherein the inverting toy comprises silicone.

9. The toy of claim 1 wherein the pulling member comprises a shape from the group consisting of: a ring shape, a spherical knob shape, a handle shape, a round knob shape, a jagged handle shape, and one or more posts.

10. A toy comprising:

an invertible shell having a first surface and a second surface, the invertible shell configured to protrude outward in a first direction until a depressing force on the first surface or the second surface in a second direction causes the shell to invert and protrude in the second direction, wherein the first direction and the second direction are substantially opposite; and a pulling member formed on and protruding outward from the first surface of the invertible shell; and an edge member formed at an edge of the invertible shell and configured to secure the invertible shell to the frame, wherein the edge member further comprises a slit that receives a notch formed on the frame, the slit and notch configured to prevent rotation of the inverting toy within the frame.

11. The toy of claim 10 further comprising a frame, wherein the frame comprises a box-shaped frame having six holes or bores for receiving of said six inverting toys, wherein one hole or bore is formed on each side of the box-shaped frame.

12. The toy of claim 10 wherein the invertible shell has a dome shape.

13. The toy of claim 10 wherein a pulling force on the pulling member in the first direction causes the invertible shell, when protruding outward in the second direction, to invert and protrude outward in the first direction.

14. The toy of claim 10 wherein the edge member comprises a trench, a flange, and a rut formed within the trench, the flange formed at an outer edge of the trench.

15. The toy of claim 14 wherein the rut activates in response to the invertible shell inverting, and wherein the rut causes a first popping sensation when the invertible shell inverts from protruding from the first direction to the second direction to be substantially equal to a second popping sensation when the invertible shell inverts from protruding from the second direction to the first direction.

16. The toy of claim 14 further comprising a securing member comprising a tab received by a slot in the frame, the securing member having a corresponding shape to the edge member to interlock with the edge member and secure the inverting toy to the frame.

17. The toy of claim 10 wherein the inverting toy comprises silicone.

18. The toy of claim 10 wherein the pulling member comprises a shape from the group consisting of: a ring shape, a spherical knob shape, a handle shape, a round knob shape, a jagged handle shape, and one or more posts.

19. A toy comprising:

a box-shaped frame having six sides and six bores or holes respectively formed on each side of the box-shaped frame;

six inverting toys to be respectively received by one of the six bores or hole, each inverting toy comprising:

an invertible shell having a first surface and a second surface, the invertible shell configured to protrude outward in a first direction with respect to the frame until a depressing force on the first surface or the second surface in a second direction causes the shell to invert and protrude in the second direction with respect to the frame, wherein the first direction and the second direction are substantially opposite;

an edge member formed at an edge of the invertible shell and configured to secure the invertible shell to the frame, wherein the edge member further comprises a slit that receives a notch formed on the frame, the slit and notch configured to prevent rotation of the inverting toy within the frame; and a pulling member formed on and protruding outward from the first surface of the invertible shell; and six securing members each respectively securing one of the six inverting toys to one of the six bores or holes.

* * * * *